US007145088B2

(12) United States Patent
Sunadome et al.

(10) Patent No.: US 7,145,088 B2
(45) Date of Patent: Dec. 5, 2006

(54) OPERATING DEVICE

(75) Inventors: Minoru Sunadome, Kawagoe (JP); Yuichi Fujimoto, Kawagoe (JP)

(73) Assignee: Pioneer Corporation, Tokyo (JP)

( * ) Notice: Subject to any disclaimer, the term of this patent is extended or adjusted under 35 U.S.C. 154(b) by 130 days.

(21) Appl. No.: 11/003,448

(22) Filed: Dec. 6, 2004

(65) Prior Publication Data

US 2005/0121297 A1 Jun. 9, 2005

(30) Foreign Application Priority Data

Dec. 9, 2003 (JP) ..... 2003-410539

(51) Int. Cl.
*H01H 25/04* (2006.01)

(52) U.S. Cl. ..... 200/6 A

(58) Field of Classification Search ..... 200/4, 200/5 R, 6 A, 17 R, 18, 332, 335; 341/20–22; 345/156, 157, 161, 168, 169, 184
See application file for complete search history.

(56) References Cited

U.S. PATENT DOCUMENTS 4,171,470 A * 10/1979 Gettig ..... 200/6 A
4,315,113 A * 2/1982 Fisher et al. ..... 200/5 R
4,348,556 A * 9/1982 Gettig et al. ..... 200/5 R
5,473,325 A * 12/1995 McAlindon ..... 200/6 A
5,804,781 A * 9/1998 Okabe ..... 200/6 A
6,897,391 B1 * 5/2005 Gavalda ..... 200/512

FOREIGN PATENT DOCUMENTS

JP 10-301485 A 11/1998

* cited by examiner

*Primary Examiner*—Michael A. Friedhofer
(74) *Attorney, Agent, or Firm*—Sughrue Mion, PLLC

(57) ABSTRACT

For providing in an operating device capable to be operated as the operator intended, an operating device has a joystick and guide member. The joystick is provided with a support portion supporting an operating shaft to swivel freely in omni-directions, and sensing switches. The sensing switches detect that the operating shaft swivels and one end thereof goes into a detecting area. A boundary is provided between the detecting areas of the neighboring sensing switches. The guide member has a through hole for passing the operating shaft. An inner edge of the through hole is formed alternately with a convex portion and a concave portion.

3 Claims, 6 Drawing Sheets

OPERATING DEVICE

BACKGROUND OF THE INVENTION

1. Field of the Invention

This invention relates to an operating device for various operations of electronic apparatuses, such as a navigation system or a game machine.

2. Description of the Related Art

For example, a navigation system (refer patent document 1) as the electronic apparatus is installed in an instrument panel of a car as a vehicle. The navigation system for a car includes a display for showing a map datum or the like, an operating device for operating display condition of the map datum shown in the display.

The operating device has a box-shaped main body, an operating shaft supported to swivel freely in omni-directions around one end of the shaft as a center by the main body and detecting switches received in the main body as a plurality of sensing devices. The detecting switches, for example eight switches, are disposed at even intervals in a circumferential direction about the one end of the operating shaft as the center.

The detecting switch detects that the one end of the operating shaft touches when the operating shaft swivels against the main body. When the one end of the operating shaft goes into a fan-shape detecting area, the center of which is at the one end of the operating shaft, the one end of the operating shaft touches to each detecting switch. The detecting areas of the plurality of detecting switches are disposed with substantially no gap and no overlap.

By a touch of the one end of the operating shaft, the sensing switch detects that the operating shaft swivels against the main body so as to tilt the other end of the operating shaft toward the detecting area. The aforesaid operating device can detect a direction of tilting the operating shaft against the main body by the touch of the one end of the operating shaft and any one of the plurality of sensing switches.

When the operating device detects the direction, the operating device outputs information to indicate the sensing switch detecting, i.e. the direction of the tilting operating shaft, toward the display. Thereby, the navigation system for the car moves a display area of the map datum shown in the display along the direction of the tilting operating shaft.

When the eight sensing switches mentioned above are provided, the navigation system can move the display area of the map datum shown in the display in eight directions of up, down, left, right, left-and-up and the others by swiveling the operating shaft against the main body. Thus, the navigation system can show wider area of the map datum than the area, which can be shown at a time in the display, by swiveling the operating shaft against the main body.

The patent reference 1 is Japan Patent Application Laid-open H10-301485.

Objects to be Solved

According to the aforesaid operating shaft used for usual navigation system for the car, when the operating shaft is tilted toward a boundary of detecting areas of neighboring sensing switches, the one end of the operating shaft touches to one of the neighboring sensing switches. Therefore, when the operating shaft is tilted toward the boundary, the sensing switch unexpected by an operator may be detected and the map datum shown in the display may be moved to a direction unexpected by the operator.

To overcome the above drawback, one object of this invention is to provide an operating device, by which an operator can operate various electronic apparatuses just as the operator intended.

SUMMARY OF THE INVENTION

How to Attain the Object

In order to attain the objects, an operating device according to this invention is specified by having an operating shaft swiveling freely in omni-directions around one end of the operating shaft as a center; a plurality of sensing devices being disposed in a circumferential direction about the one end as the center, said sensing device detecting swiveling of the operating shaft; and a guide member touching to the operating shaft when the operating shaft swivels, and specified by that the guide member is made of a flexible material, and one distance between one contact point corresponding to one location of the sensing device of the guiding member and the operating shaft is formed longer than the other distance between another contact point of the guide member corresponding to an interval of neighboring sensing devices, and the operating shaft.

In the operating device according to this invention, the guide member made of a flexible material contacts to the swiveling operating shaft, and one distance between one contact point corresponding to one location of the sensing device of the guide member and the operating shaft is formed longer than the other distance between another contact point of the guide member corresponding to the interval of the neighboring sensing devices, and the operating shaft. Thereby, when the operating shaft swivels and touches to the guide member, the operating shaft can be positioned at a position corresponding to one of sensing devices. In other words, when the operating shaft is tilted toward the center of the neighboring sensing devices, the operating shaft is positioned at another contact point corresponding to the center of the neighboring sensing devices, so that a sensing device unexpected by the operator is prevented from detecting the one end of the operating shaft.

The guide member is made of the flexible material. Thereby, when, turning the operating shaft kept to be tilted, the operating shaft touches to the guide member, the guide member is deformed elastically and the operating shaft can be turned securely. Thus, the sensing device expected by the operator can detect the operating shaft and the tilted operating shaft can be turned securely.

According to this invention, the guide member is formed to have a concave portion and a convex portion alternately, and the concave portion is the one contact point corresponding to the one location of the sensing device, and the convex portion is another contact point corresponding to the interval of the neighboring sensing devices.

The guide member may be formed into a curved surface across the concave portion and the convex portion.

The above and other objects and features of this invention will become more apparent from the following description taken in conjunction with the accompanying drawings.

DESCRIPTION OF THE PREFERRED EMBODIMENT

An operating device as one embodiment according to the present invention will be described with reference to FIGS. 1–12. The operating device 1 shown in FIG. 2 is mounted in a navigation system 2 for a car installed at a dashboard of a car as a vehicle. The navigation system 2 corresponds to an electronic apparatus described in this specification.

Figure 1:
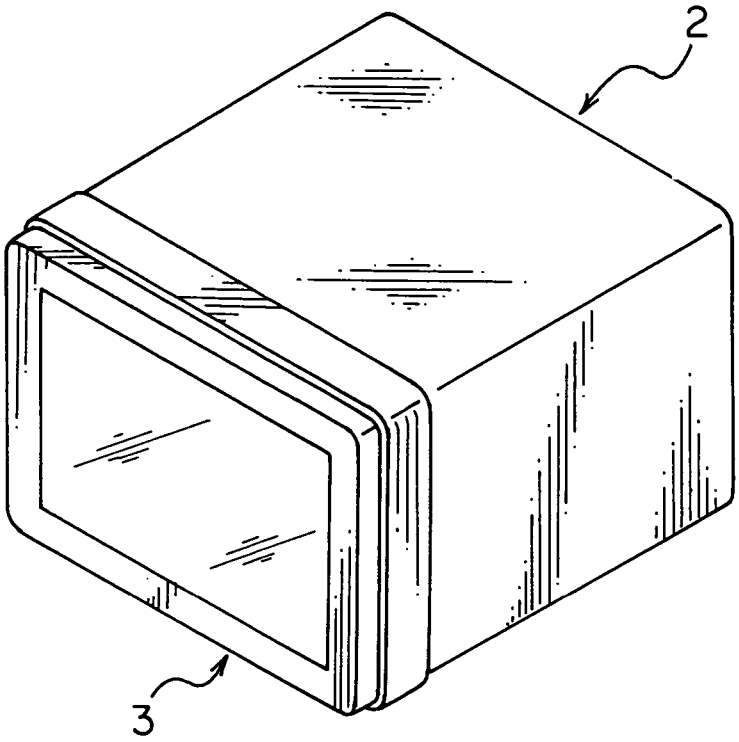
FIG. 1 is a perspective view of an external appearance of a navigation system for a car as an electronic apparatus in which an operating device of an embodiment according to this invention is mounted.
Figure 2:
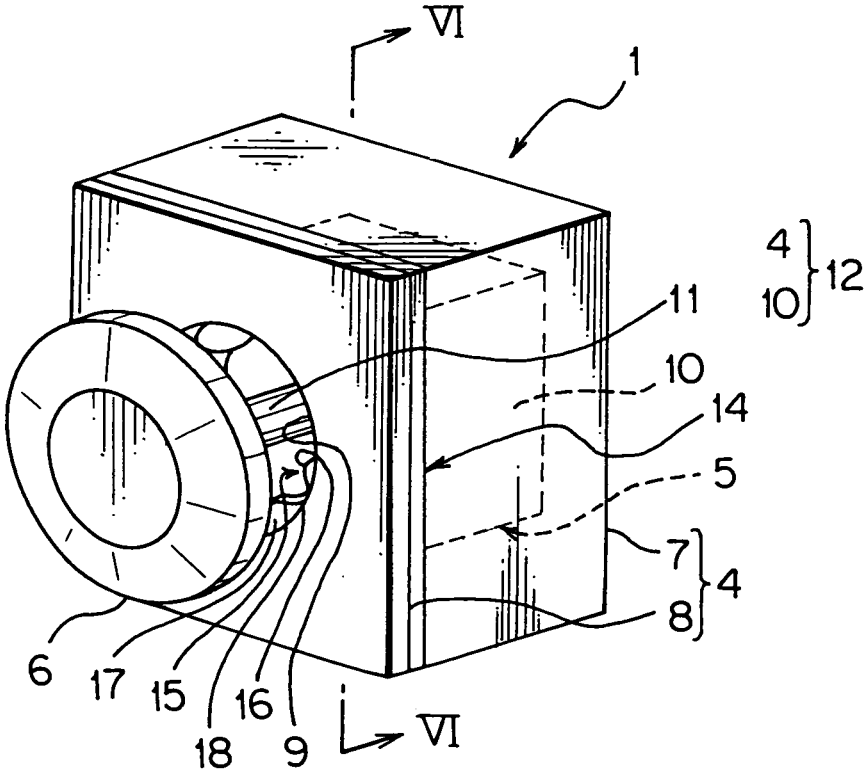
FIG. 2 is a perspective view of the operating device of the embodiment according to this invention.
Figure 3:
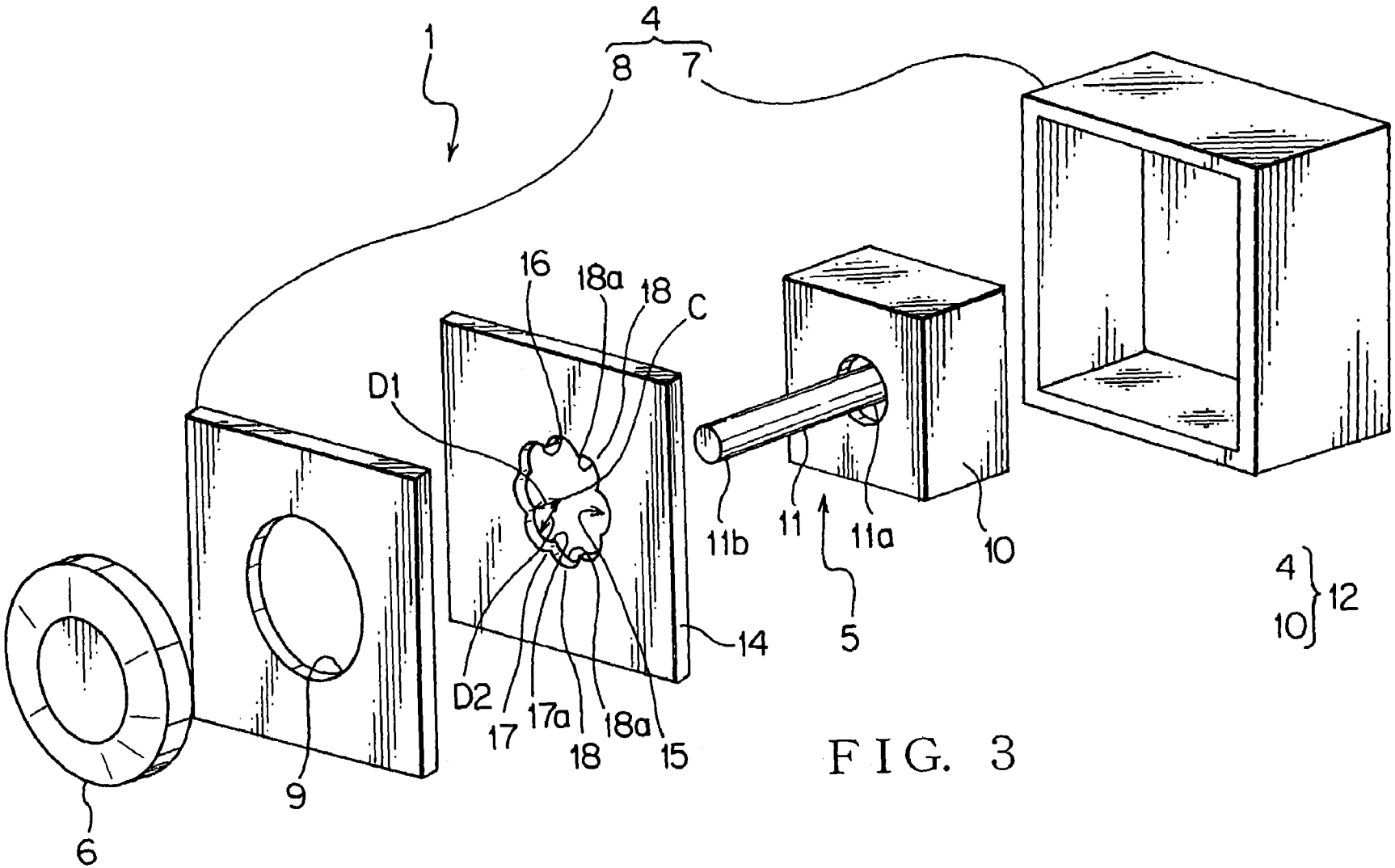
FIG. 3 is an exploded perspective view of the operating device shown in FIG. 2.
Figure 4:
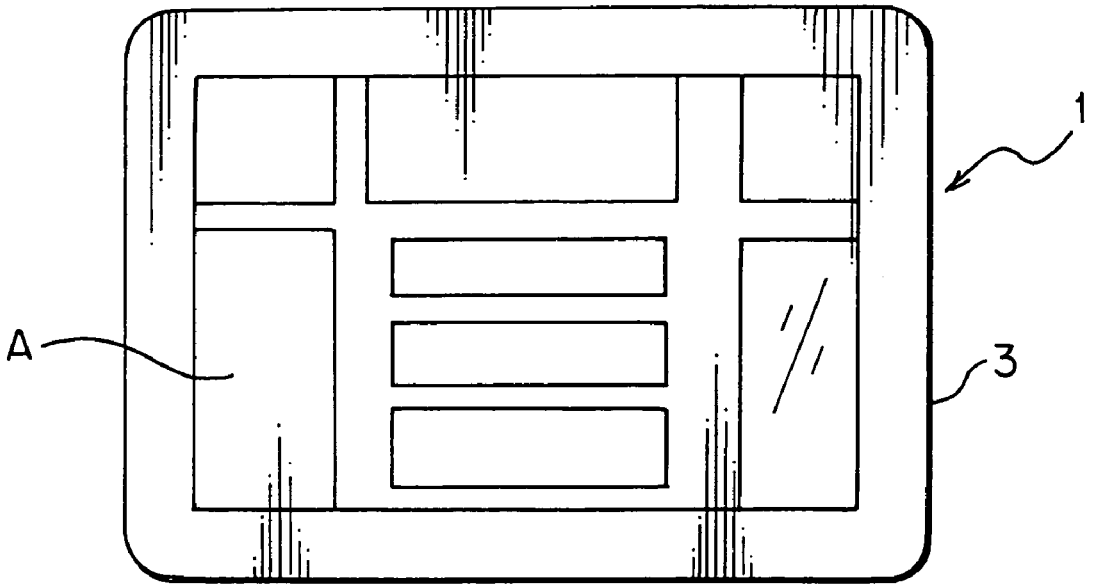
FIG. 4 is a front view of a display of the navigation system shown in FIG. 1.

The navigation system 2 has a display 3 as shown in FIG. 1. The display 3 shows a map datum A as shown in FIG. 4. The operating device 1 moves a display area of the map datum A shown in the display 3 to, for example, eight directions of up, down, left, right, left-and-up and others. The operating device 1 moves the display area of the map datum A to the eight directions in the display, so that wider area of the map datum A than an area, which can be displayed at a time in the display 3, is shown in the display 3. Thus, the operating device is used for various operations of the electric apparatuses such as the navigation system 2.

The operating device 1 includes a cover 4, a joystick 5, a knob 6 and a guide member 14, as shown in FIG. 2, 3. The cover 4 has a bottomed cylindrical bottom cover 7 and a plate-like top cover 8. The bottom cover 7 receives a later-described support portion 10 of the joystick 5. The top cover 8 is provided at the center thereof with a round hole 9 therethrough. A later-described operating shaft 11 is inserted through the hole 9. After receiving the support portion 10 in the bottom cover 7 and inserting the operating shaft 11 through the hole 9, the bottom cover 7 and the top cover 8 are fixed together with the guide member 14 therebetween. Thus, the cover 4 receives the support portion 10 of the joystick 5 inside thereof by fixing the bottom cover 7 and the top cover 8 with the guide member 14 therebetween.

The joystick 5 includes the box-shaped support portion 10 and the rod-shaped operating shaft 11, as shown in FIG. 2, 3. The support portion 10 is formed into a rectangular solid shape. The support portion 10 and the aforesaid cover 4 structure a main body 12.

One end 11*a* of the operating shaft 11 is received in the support portion 10 and the other end 11*b* thereof projects from the support portion 10. The other end 11*b* of the operating shaft 11 is exposed out of the cover 4, i.e. the main body 12. The operating shaft 11 is supported by the support portion 10 to swivel freely in omni-directions around the one end 11*a* as a center. In other words, the operating shaft 11 is supported by the main body 12 to swivel freely in omni-directions around the one end 11*a* as the center.

Figure 5:
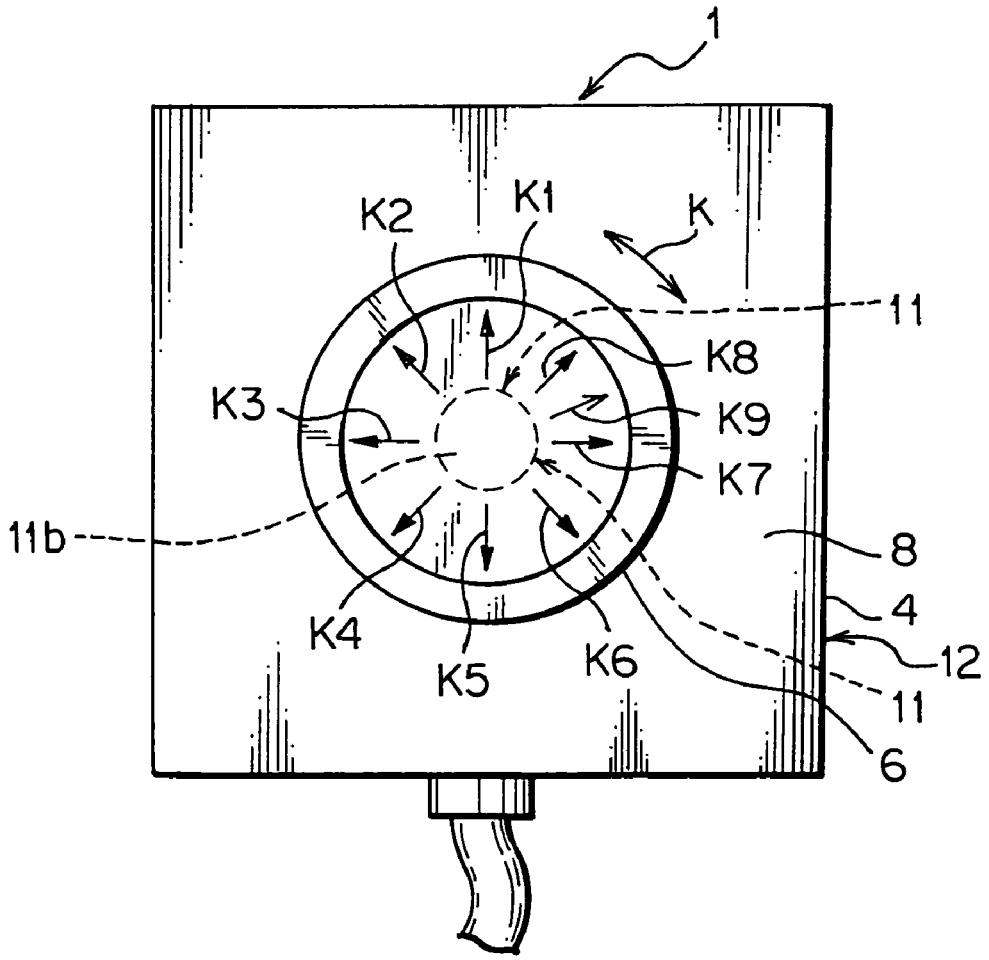
FIG. 5 is a front view of the operating device shown in FIG. 2.
Figure 8:
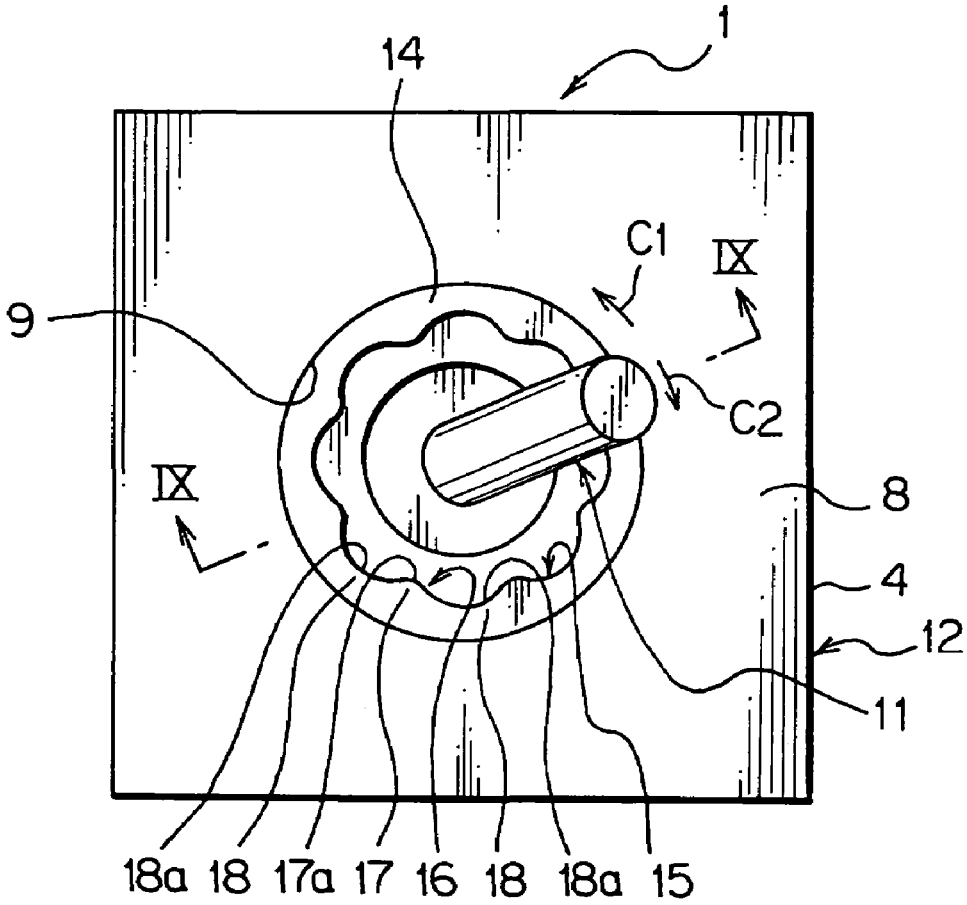
FIG. 8 is a front view, showing the operating shaft of the operating device shown in FIG. 2 positioned above a boundary.
Figure 9:
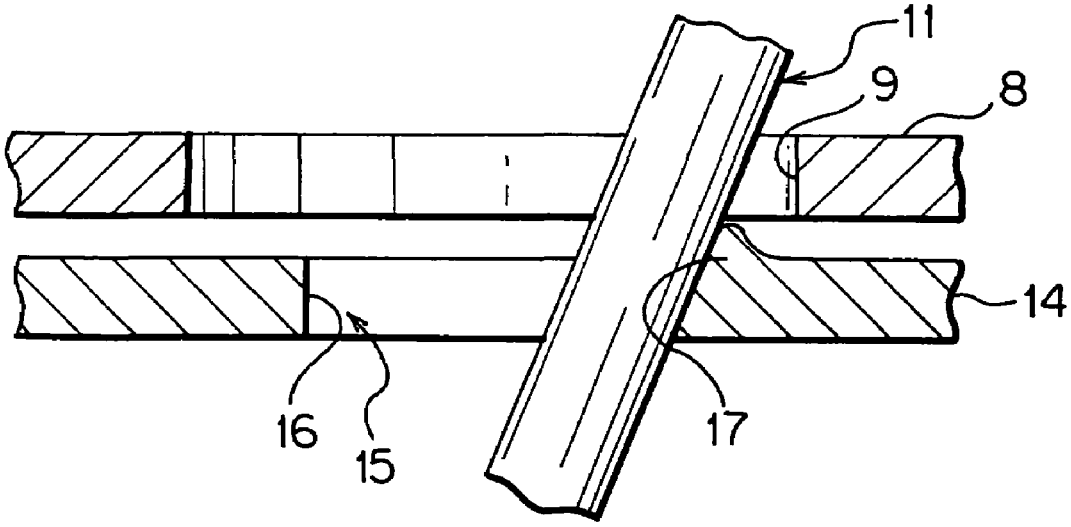
FIG. 9 is a sectional view taken along the IX—IX line in FIG. 8.
Figure 10:
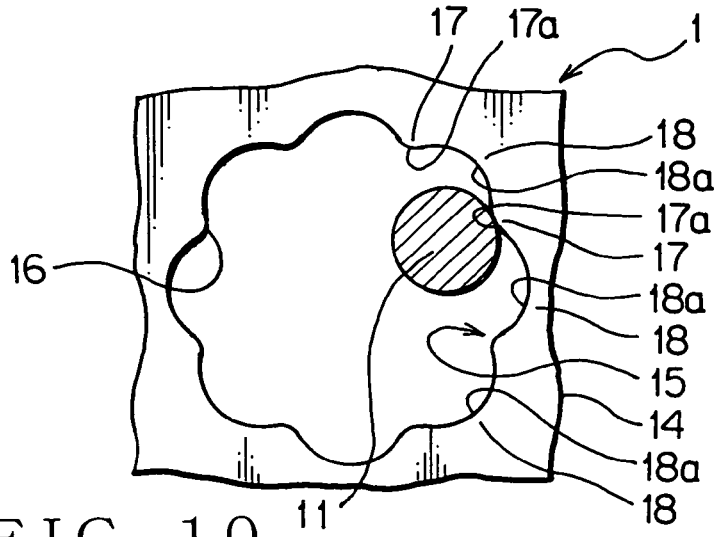
FIG. 10 is an illustration, showing a relative position of the operating shaft and a through hole of the guide member shown in FIG. 9;.

The operating shaft 11 can swivel freely against the support portion 10 respectively along each arrow K1–K8 in FIG. 5 around the one end 10*a*. The operating shaft 11, swiveling around the one end 11*a* and tilting to the support portion 10 as shown in FIGS. 8, 9, can turn freely along an arrow K in FIG. 5. The operating shaft 11 can swivel against the support portion 10 around the one end 11*a* in any directions between two of arrows K1–K8.

The operating shaft 11 is energized by a not-shown energizing device to follow along a direction perpendicular to a top surface of the support portion 10 (shown in FIG. 2). When a lengthwise of the operating shaft 11 is perpendicular to the top surface of the support portion 10, the operating shaft 11 does not tilt (swivel) to the support portion 10. A position of the operating shaft 11 and the knob 6 shown in FIG. 2 is defined as a neutral position, hereafter. The one end 11*a* of the operating shaft 11 in the neutral position does not touch to any sensing devices 13.

Figure 6:
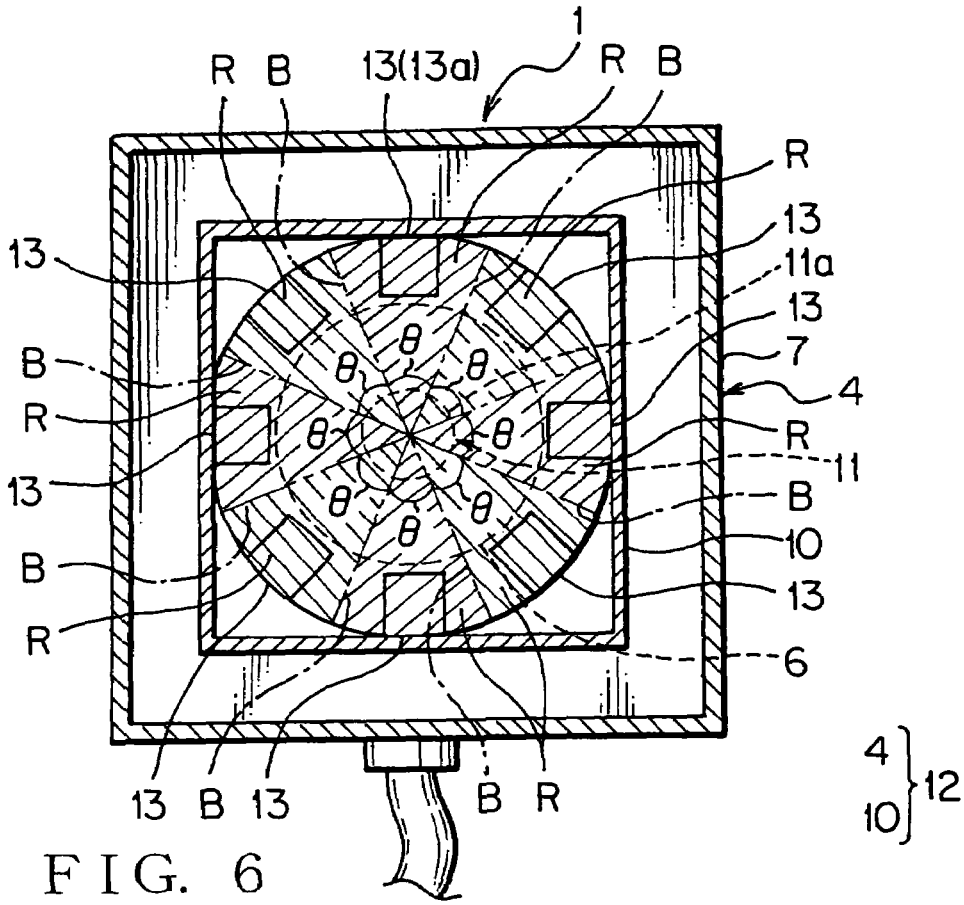
FIG. 6 is a sectional view taken along the VI—VI line in FIG. 2.

A plurality of sensing switches 13 as the sensing device is received in the support portion 10 as shown in FIG. 6. Thus, the operating device 1 includes the plurality of sensing switches 13. The sensing switches 13 are disposed at even intervals along a circumferential direction around the one end 11*a* of the operating shaft 11 as the center, as shown in FIG. 6. When the operating shaft 11 swivels against the support portion 10, and the one end 11*a* of the operating shaft 11 goes into a detecting area R shown with hatching in FIG. 6, the one end 11*a* of the operating shaft 11 touches respectively to the sensing switches 13. The sensing switch 13 detects by touching the one end 11*a* thereto that the operating shaft 11 is swiveled.

When the sensing switch 13 detects that the one end 11*a* touches thereto, i.e. the one end 11*a* goes into the detecting area R, the sensing switch 13 outputs information of detecting to the display 3, i.e. the navigation system 2. The display 3 moves the map datum A in accordance with the information outputted by the sensing switch 13. When it is detected that the one end 11*a* of the operating shaft 11 touches to the sensing switch 13*a* located at the uppermost position in FIG. 6, the display 3 moves the map datum A upwardly in FIG. 4.

The detecting area R of the each sensing switch 13 is formed into a fan-shape having an arc center of axis of the operating shaft 11, i.e. the one end 11*a*. The eight sensing switches 13 are disposed in FIG. 6, and an arc angle θ of the detecting area R of the sensing switch 13 is 45 degrees.

The plurality of detecting areas R is disposed with no gap and no overlap to each other. Thereby, when the operating shaft 11 swivels against the support portion 10 starting from the neutral position, the one end 11*a* of the operating shaft 11 touches to any one of the plurality of sensing switches 13. Boundaries B, shown with a long-dashed short-dashed line in FIG. 6, are formed respectively between the neighboring detecting areas R. The boundaries B extend radially from the axis of the operating shaft 11, i.e. the one end 11*a*.

The knob 6 is formed into a disk-shape as shown in FIG. 2, 3 and mounted on the other end 11*b* of the operating shaft 11. A diameter of the knob 6 is enough larger than that of the operating shaft 11. The knob 6 is mounted coaxially on the operating shaft 11.

The guide member 14 is made of an elastic material (corresponding to the flexible material) and formed into a plate-shape. The guide member 14 has the same shape in a plan view as the top cover 8. The guide member 14 is provided at the center thereof with a through hole 15 therethrough. The operating shaft 11 is inserted through the through hole 15. The operating shaft 11 touches to an inner edge of the through hole 15. Thus, the inner edge of the through hole 15 corresponds to one contact point against the operating shaft 11. In other words, when the operating shaft 11 swivels, the operating shaft 11 touches to the guide member 14.

Inserting the operating shaft 11 through the through hole 15, the guide member 14 is disposed between the top cover 8 and the bottom cover 7 and mounted on the top cover 8 and the bottom cover 7, i.e. the cover 4. The guide member 14 is piled on the top cover 8 so as to make the through hole 15 coaxial to the hole 9.

Figure 7:
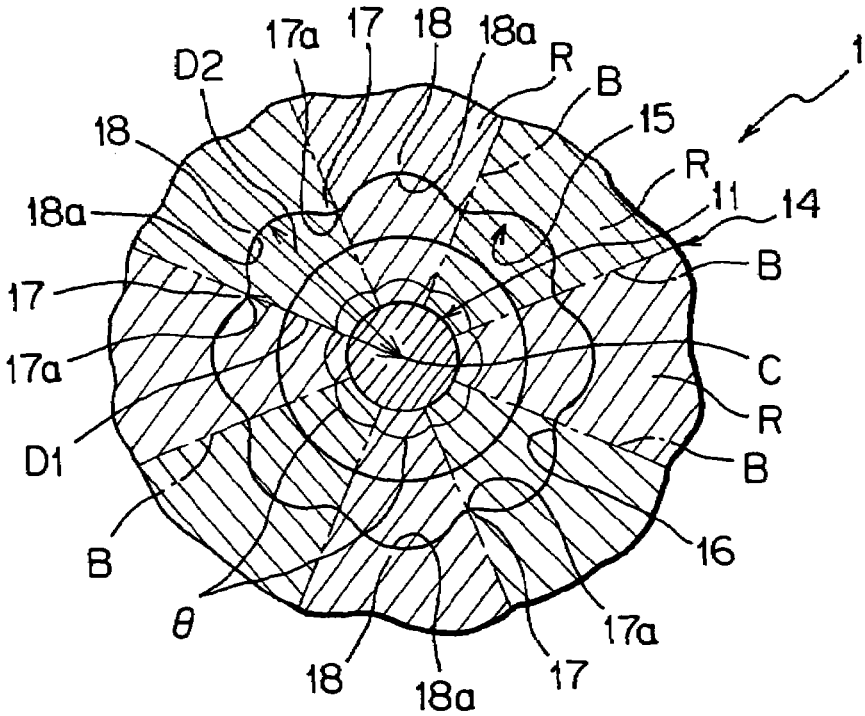
FIG. 7 is a front view, showing relative positions of a guide member, an operating shaft and a detecting area of the operating device shown in FIG. 2.

The through hole 15 is smaller than the hole 9. The through hole 15 is provided on the inner edge alternately with a convex portion 17 and a concave portion 18, as shown in FIG. 7. Then, the guide member 14 is formed alternately with the convex portion 17 and the concave portion 18. In other words, the inner edge of the through hole 15 is formed into a convexo-concave shape along a circumferential direction. At the convex portion 17, the inner edge 16 of the through hole 15 is formed convexly toward the center C of the through hole 15. At the concave portion 18, the inner edge 16 of the through hole 15 is formed concavely to be apart from the center C of the through hole 15. The convex portion 17 is closer to the center C of the through hole 15 than the concave portion 18. The concave portion 18 is more apart from the center C of the through hole 15 than the convex portion 17.

A top 17*a* of the convex portion 17 closest to the center C of the through hole 15 is disposed together with the aforesaid boundary B on a line along the lengthwise of the operating shaft 11 in the neutral position, as shown in FIG. 7. "Disposing together with the aforesaid boundary B on a line along the lengthwise of the operating shaft 11 in the neutral position" is described by "disposing above the boundary B" in this specification. Then, the convex portion 17 is disposed above the boundary B. Therefore, the convex portion 17 corresponds to another contact point against the operating shaft 11 corresponding to the interval of the neighboring sensing devices.

A bottom 18*a* of the concave portion 18 most apart from the center C of the through hole 15 is disposed together with the center of the neighboring boundaries B on a line along the lengthwise of the operating shaft 11 in the neutral position, as shown in FIG. 7. "Disposing together with the center of the neighboring boundaries B, i.e. the detecting area R on a line along the lengthwise of the operating shaft 11 in the neutral position" is described by "disposing above a position between boundaries B, i.e. the detecting area R" in this specification. Then, the concave portion 18 is disposed above the portion between the boundaries B, i.e. the detecting area R. Therefore, the concave portion 18 corresponds to the one contact point against the operating shaft 11 corresponding to the one location of the sensing switch 13.

As shown in FIG. 7, a distance D1 of the top 17*a* of the convex portion 17 disposed above the boundary B of the inner edge 16 of the through hole 15 from the center C of the through hole 15 is shorter than a distance D2 of the bottom 18*a* of the concave portion 18 disposed above the interval of the neighboring boundaries B of the inner edge 16 of the through hole 15 from the center C of the through hole 15. Thus, in the guide member 14, a distance between the concave portion 18 and the operating shaft 11 is longer than a distance between the convex portion 17 and the operating shaft 11. The inner edge 16 of the through hole 15, i.e. the guide member 14, is formed into the curved surface across the concave portion 17 and the convex portion 18.

In the aforesaid operating device 1, the support portion 10 is received in the bottom cover 7, and inserting the operating shaft 11 through the through hole 15 and the hole and disposing the guide member 14 between the covers 7, 8, the bottom cover 7, the guide member 14 and the top cover 8 are fixed together. Thereafter, the operating device 1 is structured by mounting the knob 6 on the other end 11*b* of the operating shaft 11.

For operating the navigation system 2 for a car, i.e. moving the map datum A shown in the display 3 by using the operating device 1, the operating shaft 11 is tilted to a direction which is expected to move the map datum A. Thereby, the one end 11*a* of the operating shaft 11 touches to the sensing switch 13 corresponding to the direction of tilting the operating shaft 11. Then, the map datum A shown in the display 3 moves in accordance with the direction of tilting the operating shaft 11.

For example, to move the shown map datum A upwardly in FIG. 4, the other end 11*b* of the operating shaft 11, i.e. the knob 6 is moved (tilted) upwardly along the arrow K1 in FIG. 5. Thereby, it is detected that the one end 11*a* of the operating shaft 11 touches to the sensing switch 13*a* at the most top position in FIG. 6, and information about this is outputted to the navigation system 2, i.e. the display 3. Then, the map datum A shown in the display 3 moves upwardly.

As shown in FIG. 8, tilting (swiveling) the operating shaft 11 along the arrow K9 at a center of the arrows K7, K8 in FIG. 5, the operating shaft 11 touches to the convex portion 17 of the inner edge 16 of the through hole 15 of the guide member 14, as shown in FIG. 9, 10. The tilted operating shaft 11 is disposed above the boundary B.

In accordance with tilting the operating shaft 11 against the support portion 10, the guide member 14 made of elastic material, such as a rubber, is deformed elastically to make the convex portion 17 apart from the center C of the through hole 15. When the operating shaft 11 is more tilted, i.e. the knob 6 is pushed to the top cover 8, the knob 6, i.e. the operating shaft 11, intends to move to direction of arrows C1 or C2 in FIG. 8 by elastic restoring force of the guide member 14.

In other words, the knob 6, i.e. the operating shaft 11, moves so as to make the operating shaft 11 go into the concave portion 18. When the operating shaft 11 moves to the direction of the arrow C1 in FIG. 8, the operating shaft 11 is positioned at a position shown in FIG. 11. Thereby, the one end 11*a* of the operating shaft 11 touches to the sensing switch 13 corresponding to a position of tilting the operating shaft 11, and the map datum A moves shown in the display 3.

When the one end 11*a* of the operating shaft 11 is positioned at the boundary B of the detecting areas R of the neighboring sensing switches 13, the inner edge 16 of the through hole 15 of the guide member 14 guides the operating shaft 11 to make the one end 11*a* of the operating shaft 11 go into any one of the detecting areas R of the neighboring sensing switches 13. Thus, the guide member 14 guides the operating shaft 11 to touch to any one of the neighboring sensing switches 13, when the one end 11*a* of the operating shaft 11 is positioned at the center of neighboring sensing switches 13.

Figure 11:
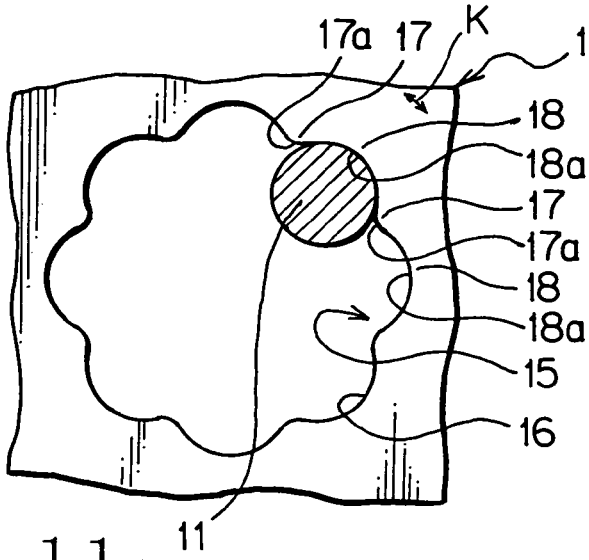
FIG. 11 is an illustration, showing the operating shaft positioned in a concave portion of the through hole of the guide member from the position shown in FIG. 9.
Figure 12:
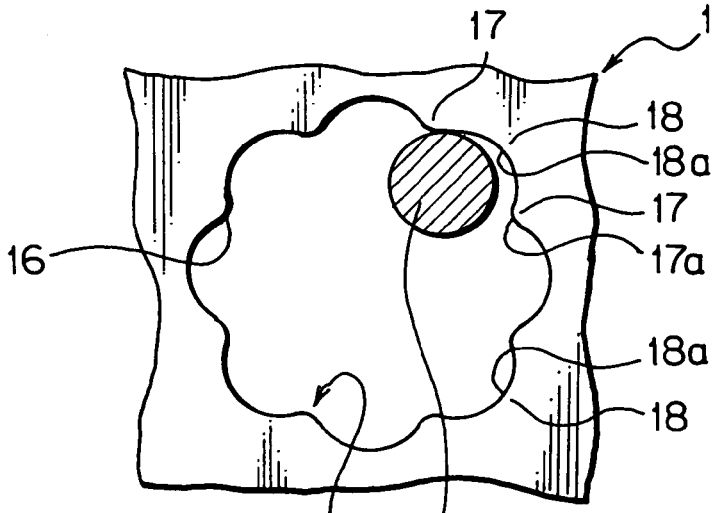
FIG. 12 is an illustration, showing the operating shaft touching to a convex portion of the through hole of the guide member by turning from a position shown in FIG. 11.

As shown in FIG. 11, the operating shaft 11, which is in the concave portion 18 by tilting against the support portion 10 from the neutral position, intends to turn around the support portion 10 along the arrow K in FIG. 11. Thereby, as shown in FIG. 12, the operating shaft 11 touches to the convex portion 17 of the inner edge 16 of the through hole 15, and the convex portion 17 pushed by the operating shaft 11 is deformed elastically to be apart from the center C of the through hole 15. Then, the operating shaft 11 tilted against the support portion 10 turns around the support portion 10.

According to this embodiment, the inner edge 16 of the through hole 15 of the guide member 14 is formed into a convexo-concave shape. And the distance D1 of the top 17*a* of the convex portion 17 as another contact point corresponding to the interval of the neighboring sensing switches 13 of the inner edge 16 of the through hole 15 from the center C of the through hole 15 is shorter than the distance D2 of the concave portion 18 as the one contact point corresponding to the one location of the sensing switch 13 from the center C of the through hole 15. Thereby, when the operating shaft 11 is swiveled against the support portion 10, the operating shaft 11 touches to the inner edge 16 of the through hole 15, and the operating shaft 11 can be positioned securely between the boundaries B by the inner edge 16.

In other words, when the operating shaft 11 is tilted to the aforesaid boundary B (the position of touching corresponding to the interval of the neighboring sensing switches 13), the operating shaft 11 is disposed above the boundary B, and the sensing switch 13 unexpected by the operator can be prevented from sensing the one end 11*a* of the operating shaft 11. Thus, the operator can make the expected sensing switch 13 detect the one end 11*a* of the operating shaft 11 by swiveling (tilting) the operating shaft 11 of the joystick 5, and can operate various electronic apparatuses, such as the navigation system 2 as the operator intended.

The guide member 14 is made of the elastic material, such as a rubber. Thereby, when the operating shaft 11 tilted against the support portion 10 turns and touches to the inner edge 16 of the through hole 15, the operating shaft 11 can turn securely because the guide member 14 is elastically deformed. Thus, the tilted operating shaft 11 can turn securely.

The through hole 15 is formed on the inner edge 16 alternately with the convex portions 17 and the concave portions 18. The convex portion 17 corresponds to the interval of the neighboring sensing switches 13, and the concave portion 18 corresponds to the one location of the sensing switch 13. Thereby, the distance D1 of another contact point corresponding to the interval of the neighboring sensing switches 13 of the inner edge 16 of the through hole 15 from the center C of the through hole 15 is securely shorter than the distance D2 of the one contact point corresponding to the one location of the sensing switch 13 from the center C of the through hole 15.

The inner edge 16 of the through hole 15 is formed into the curved surface across the convex portion 17 and the concave portion 18. Thereby, the tilted operating shaft 11 can turns smoothly.

The operating device 1 according to the aforesaid embodiment is used for operating the navigation system 2 as the electronic apparatuses. The operating device 1 can be used for various operation of many kinds of electronic apparatuses, such as usual game systems.

The aforesaid embodiment is one typical form according to this invention. This invention is not limited to embodiment, and modification and variation is possible without departing from the sprit and the scope of the invention.

According to the aforesaid embodiment, following operating devices can be provided.

Type 1: The operating device 1 includes the operating shaft 11 swiveling freely in omni-directions around one end 11*a* thereof as a center, the plurality of sensing switches 13 disposed in a circumferential direction about the one end 11*a* as the center, said sensing switches 13 detecting swiveling of the operating shaft, and the guide member 14 touching to the operating shaft 11 when the operating shaft 11 swivels. The guide member 14 is made of a flexible material. The one distance between one contact point 18 at the guide member 14 corresponding to one location of the sensing switch 13 and the operating shaft 11 is formed longer than the other distance between another contact point 17 at the guide member 14 corresponding to the interval of the neighboring sensing switches 13, and the operating shaft 11.

Type 2: The operating device 1 according to type 1 operating device is specified by that the guide member 14 is formed to have the concave portions 18 and the convex portions 17 alternately, and the concave portion 18 is the one contact point corresponding to the one location of the sensing switch 13, and the convex portion 17 is another contact point corresponding to the interval of the neighboring sensing switches 13.

Type 3: The operating device 1 according to type 2 operating device is further specified by that the guide member 14 is formed into the curved surface across the concave portion 18 and the convex portion 17.

According to the type 1 operating device 1, the guide member 14 is formed so as to make the one distance between one contact point corresponding to one location of the sensing switch 13 and the operating shaft 11 longer than the other distance between another contact point corresponding to the interval of the neighboring sensing switches 13, and the operating shaft 11. Thereby, when the operating shaft 11 is swiveled to the center of the neighboring sensing switches 13, the operating shaft 11 touches to another contact point corresponding to the interval of the neighboring sensing switches 13, and the guide shaft 11 is guided to the one contact point corresponding to the location of the sensing switch 13 by another contact point corresponding to the interval of the neighboring sensing switches 13. Thus, the guide member 14 can position the operating shaft 11 to the one contact point corresponding to the location of the sensing switch 13.

In other words, when the operating shaft 11 is tilted toward the center of the neighboring sensing switches 13, the operating shaft 11 is placed to the center of the neighboring sensing switches 13, and other sensing switch unexpected by the operator can be prevented from detecting the one end 11*a* of the operating shaft 11. Thus, the operator can make the expected sensing switch 13 detect the one end 11*a* of the operating shaft 11 by tilting the operating shaft 11, and can operate various electronic apparatuses, such as the navigation system 2 as the operator intended.

The guide member 14 is made of the flexible material (elastic material). Thereby, when the tilted operating shaft 11 turns and touches to the guide member 14, the operating shaft 11 can turn securely because the guide member 14 is elastically deformed. Thus, the sensing switch 13 expected by the operator can detect securely the operating shaft 11 and the tilted operating shaft 11 can turn securely.

According to the type 2 operating device 1, the guide member 14 is formed alternately with the convex portions 17 and the concave portions 18. The convex portion 17 corresponds to the interval of the neighboring sensing switches 13, and the concave portion 18 corresponds to the one location of the sensing switch 13. Thereby, the operator can make securely the expected sensing switch 13 detect the one end 11*a* of the operating shaft 11 by tilting the operating shaft 11, and can operate securely various electronic apparatuses, such as the navigation system 2 as the operator intended.

According to the type 3 operating device 1, the guide member 14 is formed into the curved surface across the convex portion 17 and the concave portion 18. Thereby, the tilted operating shaft 11 can turns smoothly.

Although the present invention has been fully described by way of examples with reference to the accompanying drawings, it is to be noted that various change and modifications can be made with the scope of the present invention as defined by the following claims. Incidentally, the contents of Japanese Patent Application No. 2003-410539 are hereby incorporated by reference.

What is claimed is:

1. An operating device comprising:

an operating shaft capable of swiveling freely in omnidirection around one end of the operating shaft as a center;

a plurality of sensing devices being disposed in a circumferential direction with the one end of the operating shaft at the center, said sensing devices detecting swiveling of the operating shaft; and a guide member touching the operating shaft when the operating shaft swivels;

whereby the guide member is made of a flexible material, whereby one distance between one contact point of the guide member corresponding to one location of the sensing devices and the operating shaft is formed longer than another distance between another contact point of the guide member corresponding to an interval of neighboring sensing devices, and the operating shaft.

2. The operating device according to claim 1, wherein the guide member is formed to have a concave portion and a convex portion alternately, wherein the concave portion is the one contact point corresponding to the one location of the sensing devices, and the convex portion is another contact point corresponding to the interval of the neighboring sensing devices.

3. The operating device according to claim 2, wherein the guide member is formed into a curved surface across the concave portion and the convex portion.

* * * * *